United States Patent [19]

Smith

[11] 4,212,336

[45] Jul. 15, 1980

[54] SCREWDRIVER

[76] Inventor: William C. Smith, P.O. Box 383, Barrington, Ill. 60010

[21] Appl. No.: 927,465

[22] Filed: Jul. 24, 1978

[51] Int. Cl.[2] ..... B25G 1/00

[52] U.S. Cl. ..... 145/61 L; 81/58.1; 81/177 G; 145/50 R

[58] Field of Search ..... 145/61 G, 61 L, 61 R, 145/50 R; 81/58.1, 177 G

[56] References Cited

U.S. PATENT DOCUMENTS

| | | | |
|---|---|---|---|
| D. 150,800 | 8/1948 | Magnus | 145/50 R |
| 2,071,543 | 2/1937 | Kress | 81/177 G |
| 2,522,217 | 9/1950 | Fischer et al. | 145/50 R |
| 2,620,001 | 12/1952 | Fratz et al. | 145/61 R |
| 2,672,066 | 3/1954 | Sandrock et al. | 145/50 R |
| 2,745,448 | 5/1956 | Leake | 145/50 R |
| 3,276,299 | 10/1966 | Halburian | 145/50 R |
| 3,312,260 | 4/1967 | MacNeill | 145/50 R |
| 3,424,212 | 1/1969 | Kemper | 145/50 R |
| 3,438,413 | 4/1969 | Borah | 145/50 R |
| 4,054,067 | 10/1977 | Blank | 81/58.1 |
| 4,102,375 | 7/1978 | Rossini | 145/75 |
| 4,130,152 | 12/1978 | Bolen | 145/61 L |

OTHER PUBLICATIONS

GSA Supply Catalog of Tools, dated Jan. 1978, pp. 65, 99, & 101.

*Primary Examiner*—Othell M. Simpson
*Assistant Examiner*—J. T. Zatarga
*Attorney, Agent, or Firm*—Cook, Wetzel & Egans Ltd.

[57] ABSTRACT

An improved screwdriver includes a well at the top of the handle adapted to receive a torque producing socket wrench drive and couple the torque producing drive directly to the shank of the screwdriver. In one embodiment, the well is defined as a square cross-section opening, adapted to receive the drive stud of a conventional socket wrench drive. In another embodiment the screwdriver shank, adapted to receive a standard socket wrench, extends into the well.

4 Claims, 5 Drawing Figures

FIG. 1
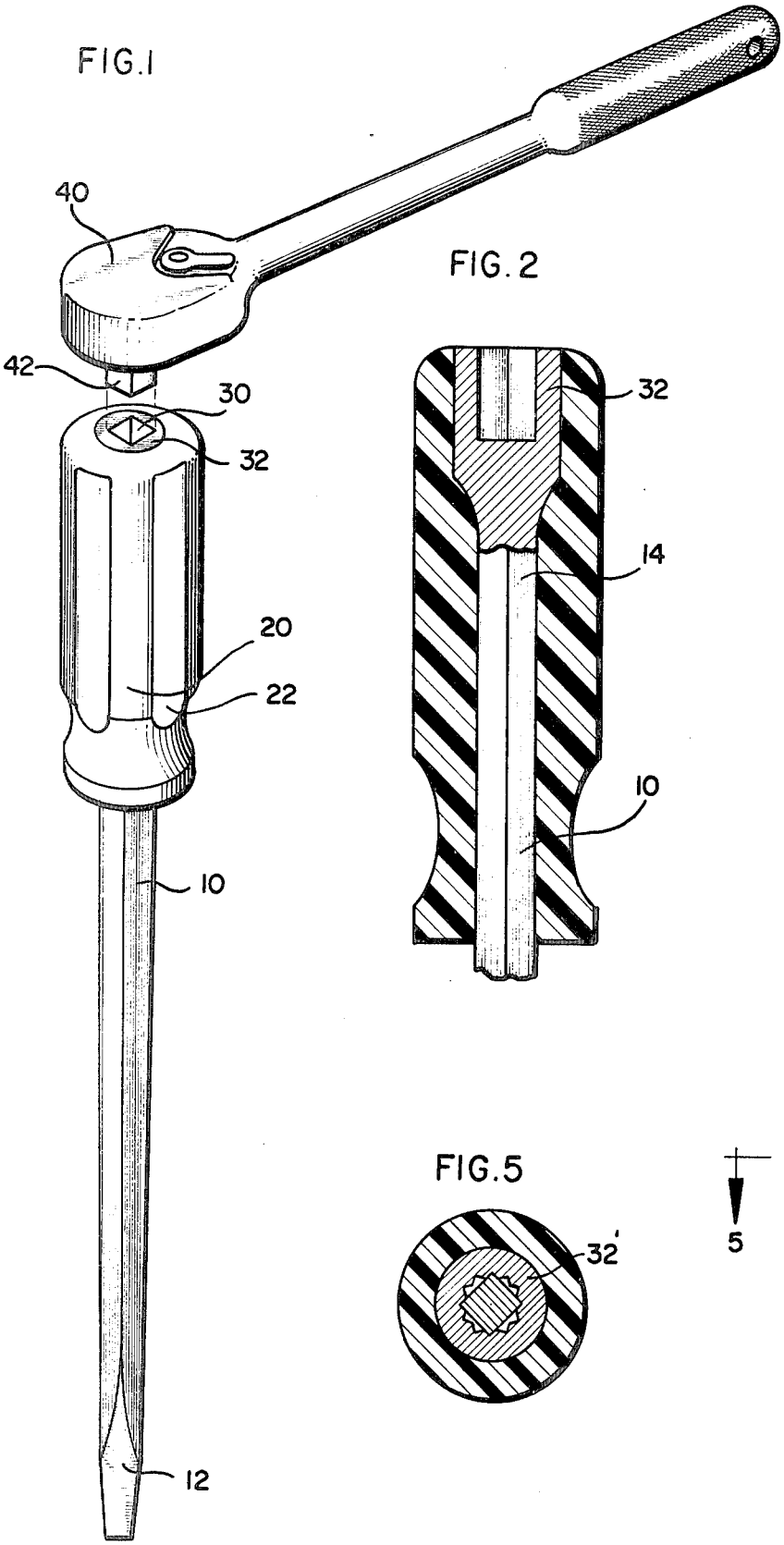
FIG. 2
FIG. 3
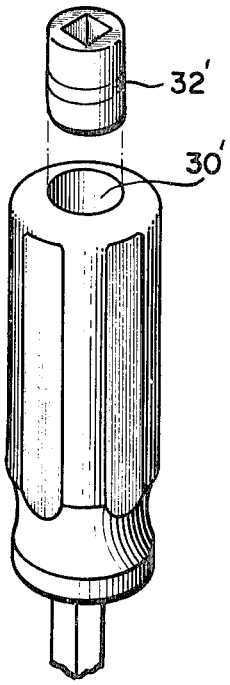
FIG. 4
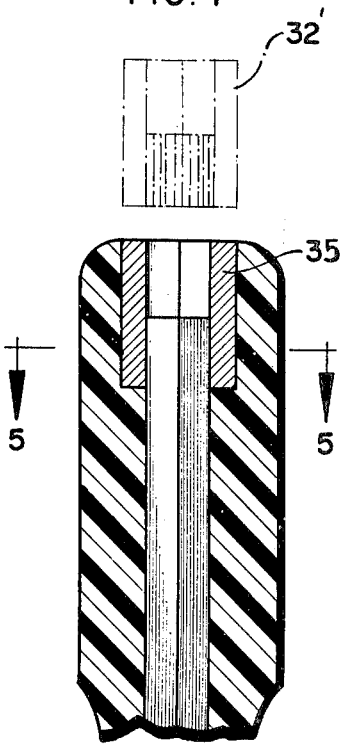
FIG. 5

SCREWDRIVER

The present invention relates to an improved screwdriver. More particularly the present invention relates to an improved screwdriver having a well in the top of the handle adapted to engage the drive stud of a conventional socket wrench ratchet or socket wrench drive tool, without in any way interfering with the utility of the screwdriver to perform its ordinary, multiple functions.

The ordinary screwdriver is one of the most useful tools known to man. Mechanics and craftsmen of various callings employ the screwdriver in many and varied functions, only one of which is the function of turning screws. Screwdrivers are conventionally used as levers to pry open paint cans, and to raise or prop up doors for purposes of installing hinges. Further, screwdrivers serve as chisels, picks, electrical grounding devices, scrapers, and in many other functions, not the least of which is the turning of screws, to both insert the screws and to remove them.

In turning screws, there are many occasions when increased torque is required in order to insert a large screw in a small hole or to remove a screw which is difficult to turn by reason of rust or other similar conditions. The torque which can be manually put on a screw using a hand-driven conventional screwdriver, is limited and is ultimately dependent upon the diameter of the handle of the screwdriver and the strength of the hand of the person using the screwdriver. Unfortunately, the human wrist is constructed in such a manner that an increased effort to turn the handle of the screwdriver will frequently cause irritation to the hand with the attendant formation of blisters and/or cause the screwdriver to move off center which, in turn, may cause the screwdriver blade to slip from the slot of the screw head, whereupon the screwdriver blade frequently damages the kerf or the slot of the screw. Additionally, when the screwdriver slips out of the slot it may embed on the surface being worked or upon the skin of the person using the screwdriver. The resulting damage to the slot of the screw makes it increasingly more difficult to bring sufficient torque to bear on the screw. Thus there is a long felt need in the art for a screwdriver device having provision for increased torque.

The prior art has proposed a number of devices which purport to solve this problem and fill this need. The prior art devices include a screwdriver blade adapted to be driven with increased torque which is applied to the head of a screw, e.g., see U.S. Pat. Nos. 1,325,070; 1,450,203; 1,743,505; 2,531,722; and 2,558,158, but all of these prior art devices involve complex structures which interfere with the use of the device as an ordinary screwdriver in functions other than turning screws, as described above.

The present invention provides a screwdriver which is conventional in appearance but which is provided with a well in the top of the handle, which well is adapted to receive drive stud of a socket wrench drive and preferably a socket wrench ratchet.

The advantages of the present invention, which reside in the details of the construction, will be more fully understood by reference to the accompanying drawings, in which:

FIG. 1 is an isometric view of the improved screwdriver of the present invention showing a conventional socket wrench ratchet in position for engagement;

FIG. 2 is a partial side view, taken in vertical section, of the handle of the preferred embodiment of the improved screwdriver;

FIG. 3 is a partial isometric view of another embodiment of the handle of the improved screwdriver of the present invention;

FIG. 4 is a partial side view, taken in vertical section, of the embodiment shown in FIG. 3; and FIG. 5 is a top view, taken in section at lines 5—5 of FIG. 4 of the embodiment shown in FIGS. 3 and 4.

Referring to the drawings, and particularly to FIG. 1, the improved screwdriver of the present invention generally comprises a shank 10 and a handle 20. The shank 10 includes a tip 12 at the lower end, adapted to engage screws. Tip 12 may either be a conventional style blade, as shown in FIG. 1, or a blade designated for Phillips head screws, not shown.

The shank 10 may be of any size or shape, but preferably is of square cross-section. Conventional screwdrivers, about 8 inches in length, conventionally have a shank formed from steel having square cross-section, about approximately ¼ inch per side. Such a size is useful for screwdrivers of the present invention. It is essential that the shank be fabricated from a high tensile steel so that the tip portion is able to withstand the increased torque developed by the improved screwdriver of the present invention, which torque may be required to turn the screw. Generally the shank is made of hardened steel, such as a molybdenum steel alloy. Because of the high torque which may be developed by the improved screwdriver of the present invention, brittle or weak alloys are not useful as the shank or screwdriver tip.

The handle 20 may be of any size or shape or material, but handles of a conventional size and shape, as are shown in the drawings, are preferred. Longitudinal grooves 22, as shown in FIGS. 1 and 3, may be positioned about the outer surface of the handle, but are not required. Preferably, the handle is produced from a lightweight plastic material, which may be readily fabricated on an economical basis and which provides a comfortable feeling handle and a screwdriver with a good balance.

Located in the upper portion of the handle 20 is well 30 defined by a steel member 32 which is in metal-to-metal contact with the shank 10 and is positioned coaxially therewith. Well 30 preferably is of square cross-section and of a size adapted to cooperate with the drive stud of a standard socket wrench drive tool. A suitable socket wrench ratchet is illustrated at 40, with a drive stud 42 extending therefrom.

Socket wrenches in the United States conventionally have drive studs of ¼ inch, ⅜ inch or ½ inch. Screwdrivers of the present invention, fitted with handles of conventional size, i.e., diameter, may be equipped with wells sizes to accommodate either the ¼ inch drive stud or the ⅜ inch drive stud. Because the ⅜ inch drive size is the most widely used, it is the preferred size for the well. The screwdriver of the present invention may be produced with a well large enough to accommodate a ½ inch drive stud, but an oversized handle is necessary. As will be apparent to those skilled in the art, conventional adaptors, which are used to affix sockets of one size to drive studs of a different size, may be employed with the improved screwdriver of the present invention.

In the preferred embodiment, as is shown in FIG. 2, well 30 is defined by socket 32 which forms a continuous one-piece structure with the upper portion 14 of the shank 10. It is preferred that the socket 32 and the shank 10 be formed of a single piece of steel wherein the upper portion of shank 14 is tapered into socket 32, as is shown more clearly in FIG. 2, but the shank 10 and socket 32 may be fabricated as two separate pieces which are joined by welding, for example.

In the screwdriver of the present invention it is essential that the socket which defines the well 30 be locked in metal-to-metal contact with the upper portion 14 of shank 10 in order to provide a continuous metal structure to transmit the torque from the well 30 to the tip 12 of the screwdriver. Handles made of relatively lightweight plastic, which produce comfortable lightweight screwdriver handles, may have a relatively low tensile and particularly as the temperature conditions vary, frequently lack the stength or adhesive character necessary to transmit the torque from the well 30 to the tip 12 of the screwdriver. Because the socket wrench drive tools are adapted to generate high torque to the well 30 at the top of the screwdriver, the metal-to-metal contact between well 30 and shank 14 of the screwdriver is deemed essential.

In the preferred embodiment, as is shown in FIG. 2, well 30 is defined by a socket 32 which forms a continuous one-piece structure with the shank 10, preferably formed from a single piece of steel. In such an embodiment, the upper portion 14 of shank 10, may be flared to form a socket 32 which defines well 30. Alternatively, the shank 10 and the socket 32 may be separately fabricated and subsequently joined, as by welding, prior to the addition of the screwdriver handle portion. Irrespective of which style of construction is used, the preferred embodiment contemplates a one-piece unitary structure, as shown in FIG. 2, wherein socket 32 is in permanently fixed, metal-to-metal contact with upper portion 14 of shank 10. This structure provides for transmission of maximum torque from the well through a continuous metal structure to the screwdriver tip, while at the same time avoids the loss of socket which defines the well 30.

An alternate embodiment of the present invention is illustrated in FIGS. 3, 4, and 5. In this embodiment, the plastic handle 20 includes an opening 35 which is large enough to accommodate a socket 32'. The socket 32' has two openings, one adapted to engage the upper portion 14 of shank 10, and the other adapted to receive the drive shank of a socket wrench drive tool. Socket 32' may be a conventional socket wrench wherein one end is adapted to engage the drive stud of a ¼ inch or ⅜ inch ratchet, for example, or while the other end may be a ¼ inch 12-point socket, as is shown in FIG. 5, adapted to engage the upper portion 14 of shank 10. Alternatively, the socket 32 may be used in the reverse position, wherein the square opening engages the upper portion 14 of shank 10, while the conventional 12-point socket opening is employed to engage the drive stud of the socket wrench drive tool.

The present invention contemplates a structure within the embodiment shown in FIGS. 3–5, wherein the cross-sectional shape of upper portion 14 of the shank 10 is modified to readily engage socket 32'. For example, the upper portion 14 of shank 10, i.e., the portion which protrudes into well 30, as is shown in FIG. 4, may be shaped to have a hexagonal cross-section. Such a structure is particularly adapted to using a 6-point socket 32' to engage the shank, while the drive stud of the socket wrench driving tool engages the square end of the socket.

Those skilled in the art will appreciate that the screwdriver of the present invention has many advantages and may be adapted to various forms of usage. For example, the screwdriver of the present invention is well adapted to applying torque to screws wherein there is little or no room adjacent to the handle of the screwdriver, thus making it difficult to grasp the screwdriver. In this case, the socket wrench driving tool enables the user to apply torque to the screw without the need to grasp the handle of the screwdriver. Further, the screwdriver of the present invention includes a well adapted to receive extensions which are customarily used with socket wrench sets, whereby the effective length of the screwdriver may be increased with the socket wrench driving tool providing adequate torque to the effectively extended screwdriver. The present invention further provides a tool which may be used by a woman or a child to accomplish jobs which could not be accomplished by such a person manually. Thus, the present invention enables a woman to turn screws which she simply does not have the strength to turn without the addition of a mechanical lever.

These and other advantages which will be obvious to those skilled in the art are provided by the present invention, without interfering or diminishing in any way from the effectiveness of the tool to carry out the common and varied functions of an ordinary screwdriver. The forms of invention herein shown and described are to be considered only as illustrative. It will be apparent to those skilled in the art that numerous modifications may be made therein without departure from the spirit of the invention or the scope of the appended claims.

I claim:

1. An improved screwdriver comprising a steel shank and a lightweight plastic handle surrounding the upper end of said shank, said shank including a standard tapered screwdriver tip at the lower end, said tip adapted to engage slots or kerfs of standard screws, and an upper end of square or hexagonal cross-section, a cylindrically shaped opening or a well positioned in the upper end of said handle, coaxial with the axis of said shank, said opening or well being large enough to receive the socket of a standard socket wrench, the upper portion of said shank extending into said opening or well, whereby said well is adapted to receive a standard socket wrench in engagement with the upper end of said shank.

2. An improved screwdriver as described in claim 1, wherein the upper portion of said shank which extends into said well has a hexagonal cross-section.

3. An improved screwdriver, as defined in claim 1, wherein the upper portion of said shank, which extends into said opening or well, is below the upper surface of the plastic handle.

4. An improved screwdriver as described in claim 3, wherein the shank which extends into said opening or well has a hexagonal cross-section.

* * * * *